US008111156B2

(12) United States Patent
Song et al.

(10) Patent No.: US 8,111,156 B2
(45) Date of Patent: Feb. 7, 2012

(54) INTRUDER DETECTION SYSTEM AND METHOD

(75) Inventors: Kai-Tai Song, Hsinchu (TW); Chia-Hao Lin, Guangfu Township (TW); Chih-Sheng Lin, Sinjhuang (TW); Su-Hen Yang, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 483 days.

(21) Appl. No.: 12/262,152

(22) Filed: Oct. 30, 2008

(65) Prior Publication Data

US 2009/0303042 A1 Dec. 10, 2009

(30) Foreign Application Priority Data

Jun. 4, 2008 (TW) ..... 97120689 A

(51) Int. Cl.
*G08B 13/00* (2006.01)

(52) U.S. Cl. ..... 340/541; 340/539.22; 340/565; 700/245

(58) Field of Classification Search ..... 340/541, 340/565–567, 539.22, 539.23; 700/245
See application file for complete search history.

(56) References Cited

U.S. PATENT DOCUMENTS 5,202,661 A * 4/1993 Everett et al. ..... 340/565
6,895,305 B2 5/2005 Lathan et al.
7,030,757 B2 4/2006 Matsuhira et al.
7,154,392 B2 12/2006 Rastegar et al.
7,174,238 B1 2/2007 Zweig
2004/0236466 A1 * 11/2004 Ota et al. ..... 700/245
2010/0045457 A1 * 2/2010 Krill ..... 340/539.22

OTHER PUBLICATIONS

Kim, Yoon-Gu, et al., "Home Security Robot Based on Sensor Network", "Proc. of SICE-ICASE, International Joint Conference", Oct. 2006, pp. 5977-5982, Published in: Bexco, Busan, Korea.

Luo, Ren C., et al., "The Development of Intelligent Home Security Robot", "Mechantronics, 2005. ICM '05. IEEE International Conference on Mechatronics", Jul. 10-12, 2005, pp. 422-427.

* cited by examiner

*Primary Examiner* — Thomas Mullen
(74) *Attorney, Agent, or Firm* — Hultquist, PLLC; Steven J. Hultquist; Kelly K. Reynolds

(57) ABSTRACT

This invention is an intruder detection system which integrates wireless sensor network and security robots. Multiple ZigBee wireless sensor modules installed in the environment can detect intruders and abnormal conditions with various sensors, and transmit alert to the monitoring center and security robot via the wireless mesh network. The robot can navigate in the environment autonomously and approach to a target place using its localization system. If any possible intruder is detected, the robot can approach to that location, and transmit images to the mobile devices of the securities and users, in order to determine the exact situation in real time.

18 Claims, 6 Drawing Sheets

INTRUDER DETECTION SYSTEM AND METHOD

CROSS REFERENCE TO RELATED APPLICATION

This application claims priority under the provisions of 35 USC §119 of Taiwanese Patent Application No. 97120689 filed Jun. 4, 2008 in the name of Kai-Tai SONG, et al. The disclosure of the foregoing application is hereby incorporated herein in its respective entirety, for all purposes.

FIELD OF THE INVENTION

The present invention relates to an intruder detection system, which integrates a wireless sensor network and security robots.

BACKGROUND TO THE INVENTION

It has been known in the prior art that a robot can receive information from a wireless sensor and execute a corresponding command in accordance with the information to interact with a user. However, such kind of robot lacks security-related functions and cannot deal simultaneously with a plurality of sensors in the environment. For example, U.S. Pat. No. 6,895,305 (the related prior art 1) has disclosed such a technology.

There is also a security robot capable of communicating with sensors in the environment and detecting, in combination with its own sensors, abnormal conditions. However, in such a technology, the sensors in the environment must communicate with each other through a wired network and thus cannot be used immediately upon installed. For example, U.S. Pat. No. 7,030,757 (the related prior art 2) has disclosed such a technology.

In addition, U.S. Pat. No. 7,174,238 (the related prior art 3) and its family patents have disclosed the technology of a robot integrating network servers and RF wireless telecommunication modules. The user can control the robot to move to the vicinity of a sensor in the environment for reading the information thereof. However, the robot is remotely controlled and itself does not have the ability to autonomously move; also, there is no network communication function between the sensors.

U.S. Pat. No. 7,154,392 (the related prior art 4) discloses a detection network constituted by deploying a plurality of wireless signal transmitting/receiving modules on a mobile platform to detect and track intruders. The mobile platform can be located by the wireless signal network. However, this system is not integrated with the image monitoring function and thus whether the detected result is correct cannot be confirmed immediately; also, the control of the mobile platform is not described in detail.

In addition, according to "The Development of Intelligent Home Security Robot," published by Ren C. Luo, Tung Y. Lin and Kuo L. Su (the related prior art 5), the security robot can receive the detected result from the sensors in the environment and detect, in combination with its own sensors, abnormal conditions. However, there is no network communication function between the sensors in the environment.

Further, according to "Home Security Robot based on Sensor Network," published by Y. G. Kim, H. K. Kim, S. H. Yoon, S. G. Lee and K. D. Lee (the related prior art 6), a robot is enabled also by the establishment of a sensor network to move to the place where there may be an abnormal condition and transmit images back to the user. However, the robot is positioned by using infrared ray and sonar and thus the sensors must be installed on the ceiling, which constitutes a limitation on the number and position of sensors to be installed.

THE RELATED PRIOR ART

Robotic apparatus and wireless communication system (U.S. Pat. No. 6,895,305)

Security system and moving robot (U.S. Pat. No. 7,030,757)

Mobile robotic system with web server and digital radio links (U.S. Pat. No. 7,174,238)

Wide-area intruder detection and tracking network (U.S. Pat. No. 7,154,392)

Ren C. Luo, Tung Y. Lin and Kuo L. Su, "The Development of Intelligent Home Security Robot," in Proc. of the 2005 IEEE International Conference on Mechatronics, July 2003, pp. 422-427

Y. G. Kim, H. K. Kim, S. H. Yoon, S. G. Lee and K. D. Lee, "Home Security Robot based on Sensor Network," in Proc. of SICE-ICASE, 2006, Bexco, Busan, Koera, October 2006, pp. 5977-5982

SUMMARY OF THE INVENTION

In view of the drawbacks of the prior art, the object of the present invention is to provide an intruder detection system, which has a networked monitoring function. If an outsider intrudes, a robot will autonomously move to the place where an abnormal condition occurs, to real-time capture images and real-time transmit the captured images, so that security guards or the homeowners, who are going out, can immediately be aware of the abnormal condition occurring in the house. Also, the user can realize the condition in time by receiving the image information so as to judge whether to report to the security guards or notify other authorities. In addition, the sensors for the monitoring function can be used immediately upon installation. Therefore, both the sensor application and the freedom of installment are increased, and the construction cost can be reduced at the same time.

In order to achieve the aforementioned object, the present invention provides an intruder detection system having the networked monitoring function, comprising: a plurality of sensors, deployed everywhere in the environment for security, one of said plurality of sensors sending a signal comprising the identification (ID) number of said sensor when detecting an intrusion condition; a wireless network for transmitting said intrusion signal sent by said sensor, said plurality of sensors constituting the nodes of said wireless network; a robot capable of autonomously patrolling for receiving said intrusion signal through said wireless network, locating said sensor in accordance with the ID number of said sensor, approaching said location to capture an environmental image with respect to an environmental condition, and sending said environmental image via a wireless image transmitting device after compressing said environmental image; and a remote receiving device for receiving said environmental image.

Preferably, the wireless network constituted of the plurality of sensors is constituted as a mesh network, so that the intrusion signal sent by the sensor at any node can be transmitted to the robot via other nodes. The robot can receive the intrusion signal through the mesh network without approaching the sensor sending the signal.

Further, the positioning function of the robot is implemented by adjusting the weight between the positioning method which positions the robot according to the RF signal strength of a plurality of wireless sensor nodes and the odometer positioning method which positions the robot by estimating the traveling distance and orientation of the robot itself, so as to overcome the problems of accumulated error in position estimation of conventional odometer method and insufficient precision of wireless signal strength positioning.

Also, the robot can further comprise a distance measuring device. The distance between the robot and an obstacle can be measured by the distance measuring device and the traveling path of the robot can thus be adjusted.

Also, the plurality of sensors can be any one kind of pyro sensor, capacitance microphone sensor and 3-axis accelerometer (vibration detector), and different kinds of sensors can be used in one system. The intrusion condition comprises any one of abnormal sound, abnormal vibration and someone approaching, and different kinds of sensors can be used in one system to detect various intrusion conditions.

Further, the wireless image transmitting device is any one of an RF wireless transmitting device, a 3G mobile-phone card and a WiFi wireless network device. The remote receiving device is a notebook computer, a personal digital assistant (PDA), a smart phone or other mobile devices having the network function.

According to another aspect of the present invention, an intruder detection method integrating a wireless sensor network and security robots is provided, comprising: an intruder detection step, in which one of a plurality of sensors deployed everywhere in the environment sends an intrusion signal comprising the ID number of said sensor when detecting an intrusion condition; an intrusion signal transmitting step, in which said intrusion signal is transmitted through a wireless network; an environmental image capturing step, in which a robot having the ability to autonomously patrol receives said intrusion signal through said wireless network, locates said sensor in accordance with the ID number of said sensor, approaches said location to capture an environmental image with respect to an environmental condition, and sends said environmental image via a wireless image transmitting device after compressing said environmental image; and a remote receiving step, in which a remote receiving device receives said environmental image.

Preferably, the wireless network is constituted as a mesh network, so that the intrusion signal sent by the sensor at any node of the mesh network can be transmitted to the robot via other nodes. Therefore, the robot can receive the intrusion signal without approaching the sensor sending the signal.

Also, the robot can adjust the weight between the positioning method which positions the robot according to the RF signal strength of a plurality of wireless sensor nodes and the odometer positioning method which positions the robot by estimating the traveling distance and orientation of the robot itself, so as to overcome the problems of accumulated error in position estimation of conventional odometer method and insufficient precision of wireless signal strength positioning.

Further, the robot can measure the distance between the robot and an obstacle with a distance measuring device so as to adjust the traveling path of the robot.

According to the intruder detection system and method of the present invention integrating a wireless sensor network and security robots, first, a plurality of sensors for detecting abnormal conditions are deployed in the environment to constitute a security wireless sensor network. The robot is kept on standby or patrols along a fixed path in accordance with the mode set in advance. If there is an outsider intruding, vibration occurring as a result of glass broken, or other abnormal sound, the robot will immediately move to the place where the abnormal condition occurs to capture images and transmit the captured images in real time, so that the security guards and the homeowners, who are going out, can immediately be aware of the abnormal condition occurring in the house. Also, the image information received via a mobile device such as, for example, a 3G cellular phone enables people to realize the condition in time and judge whether to report to the security guards or notify other authorities. In addition, the sensors for the monitoring function can be used immediately upon installed. Therefore, both the sensor application and the freedom of installment are increased, and the construction cost can be reduced at the same time.

BRIEF DESCRIPTION OF THE DRAWINGS

FIG. 10 is a flowchart of system information transmission according to the present invention, where

DESCRIPTION OF PREFERRED EMBODIMENTS

Figure 1:
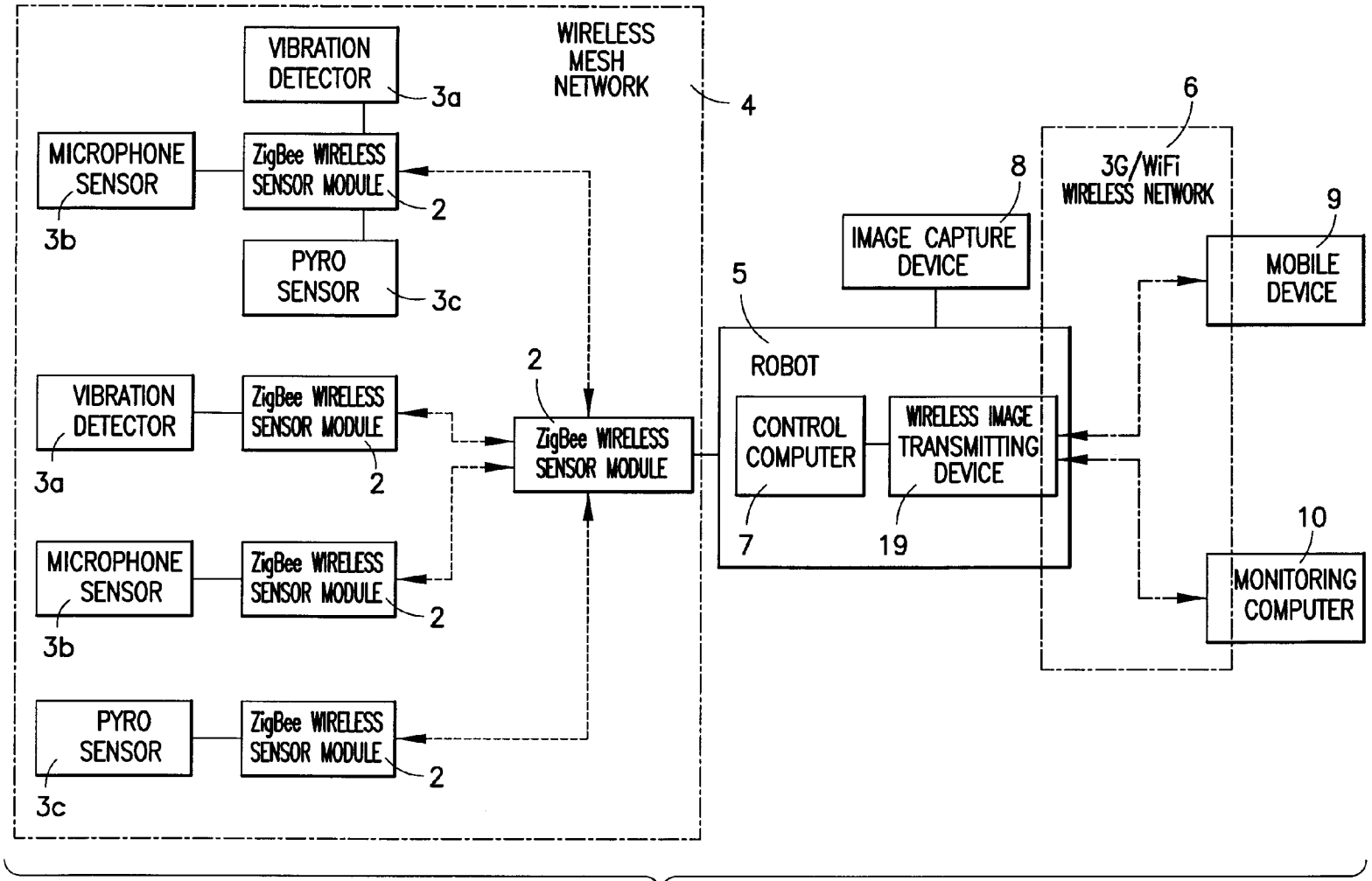
FIG. 1 is a diagram showing the hardware architecture of the intruder detection system of the present invention.

FIG. 1 shows a hardware architecture according to an embodiment of the present invention. First, a specific number of Zigbee wireless sensor modules 2 are deployed in the environment to connect with the sensors 3 of the present invention. Depending on the location, vibration detector (accelerometer) 3*a*, microphone sensors 3*b*, pyro sensors 3*c*, or the like are selected. An intrusion signal collected by these sensors 3 is actively transmitted to a security robot 5 through a ZigBee wireless mesh network 4. A control computer 7 connecting with a 3G/WiFi communication network 6 is provided on the mobile platform of the robot 5. The computer 7 is connected with a network camera 8 and the Zigbee wireless sensor modules 2 to form a complete security system architecture, which constitute the intruder detection system 1 of the present invention. The robot 5 takes charge of receiving the intrusion signal sent by each of the Zigbee wireless sensor modules 2 in the environment and transmits environmental images via a wireless image transmitting device 19, captured by an image capture device 8 to a user's 3G cellular phone or other mobile device 9 or a monitoring computer 10 in a monitoring center through the 3G/WiFi communication network 6.

Figure 2:
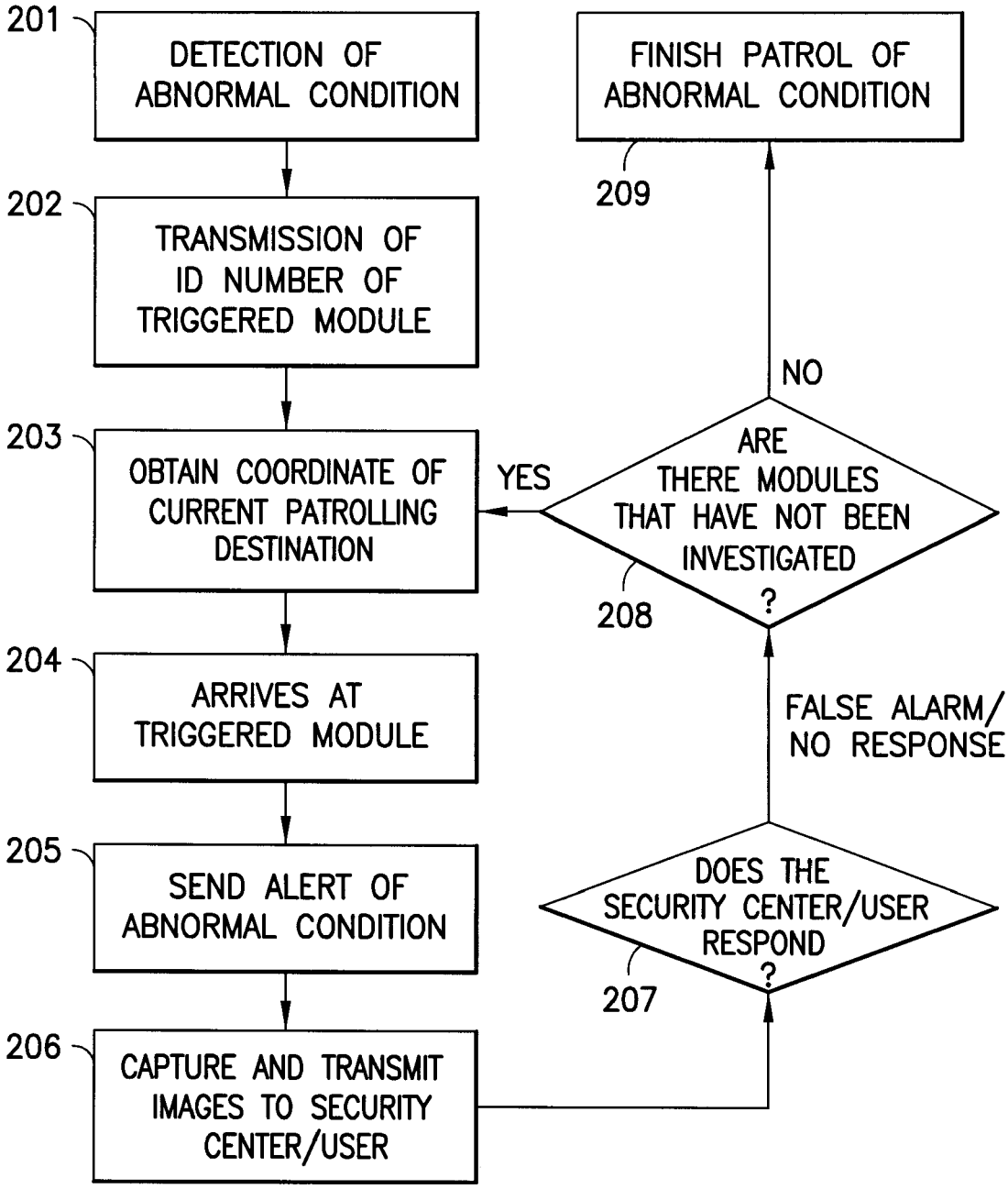
FIG. 2 is an operational flowchart of the intruder detection system of the present invention.

FIG. 2 shows the whole operational procedure of this embodiment. When the Zigbee wireless sensor module 2 detects an abnormal condition (201) and is thus triggered, the ZigBee wireless mesh network 4 will transmit the ID number of the triggered Zigbee wireless sensor module 2 (202) as an intrusion signal to the robot 5, and the robot 5 examines whether the triggered module had been previously triggered and registered. If the module had not been previously triggered (208), indicative of a newly occurring intrusion event, the coordinates of the place at which the Zigbee wireless sensor module 2 is located are scheduled in the patrol task. Every time when arriving at the place of the triggered Zigbee wireless sensor module 2 (204), the robot 5 will look around to capture real-time images therefrom with the image capture device 8 (for example, a Pan-Tilt camera or a plurality of cameras), and transmits the captured environmental images (206) to the user's mobile device 9 or the monitoring computer 10 in the monitoring center for judging whether an abnormal condition occurs (207).

The intruder detection system 1 of this embodiment integrating a security sensor network and security robots can connect with an existing security system through the ZigBee wireless mesh network 4 constituted of the Zigbee wireless sensor modules 2 randomly deployed everywhere in the environment. As to the sensor 3 installed in the Zigbee wireless sensor module 2 of the intruder detection device, a pyro sensor 3*c*, a capacitance microphone sensor 3*b*, a 3-axis accelerometer (vibration detector) 3*a* or the like can be used, for example. The Zigbee wireless sensor module 2 itself has computing power and preprocesses the detection data from the sensors to judge whether there are intruders. If a certain Zigbee wireless sensor module 2 detects an intrusion condition, the ID number of the Zigbee wireless sensor module 2 detecting the intrusion condition is immediately transmitted to the robot 5 through the ZigBee wireless mesh network 4 to trigger its patrol mode. The robot 5 has the ability to patrol autonomously. If more than one sensor is triggered, the robot 5 will record the order of occurrence in the patrol task. With the ZigBee wireless mesh network 4, the robot 5 itself is able to receive the intrusion signals from all the Zigbee wireless sensor modules without approaching a specific module. In accordance with the ID number of the Zigbee wireless sensor module 2, the robot 5 can obtain the coordinates of the Zigbee wireless sensor module 2 from a database. Then, the robot 5 moves itself to the location of the triggered Zigbee wireless sensor module 2 with the autonomous navigation/obstacle avoidance ability and the orientation estimation ability of the robot 5 in combination with the positioning information provided by the Zigbee wireless sensor module 2. After arriving at the target place, the robot 5 can, for example, firstly send a short message to alert the security center and the user. Then, the robot 5 rotates in situ to capture environmental images with the image capture device 8 such as a webcam, a NTSC camera or the like, and sends the environmental images, which are compressed in, for example, JPEG format, to the monitoring computer 10 in the security center and the user's mobile device 9 through a WiFi or 3G network. If finding suspicious conditions, the security center or the user can remote control the robot with the control software installed on the monitoring computer 10 or the mobile device 9 such as, for example, a notebook, a PDA, a smart phone or the like, or directly with a web interface. If the security center and the user make no response or ascertain it is a false alarm, the robot 5 will move to the next destination assigned in the patrol task. If there is no other destination assigned in the patrol task, the robot 5 will revert to the normal patrol mode.

The self-positioning function enables the robot 5 to dynamically adjust the weighting of the result of its odometer estimation and the result of received signal strength positioning with a fuzzy system in accordance with the route of the robot 5 and the ZigBee wireless signal strength, so as to overcome the problems of accumulated error in position estimation of conventional odometer method and insufficient precision of wireless signal strength positioning.

The self-navigation function enables the robot 5 to obtain the information about environmental distance with a distance measuring device such as an ultrasonic ranging system or laser scanner and to dynamically fuse the weights of three kinds of navigation behavior: progression towards an intended destination, obstacle avoidance and wall following, via a fuzzy neural network, which can be applied to various robotic mobile platforms.

(A Detection System Constituted of Wireless Sensor Modules)

The Zigbee wireless sensor module 2 for detecting abnormal conditions used in this embodiment can connect with a pyro sensor 3*c*, a capacitance microphone sensor 3*b*, a 3-axis accelerometer (vibration detector) 3*a* or the like.

Figure 3:
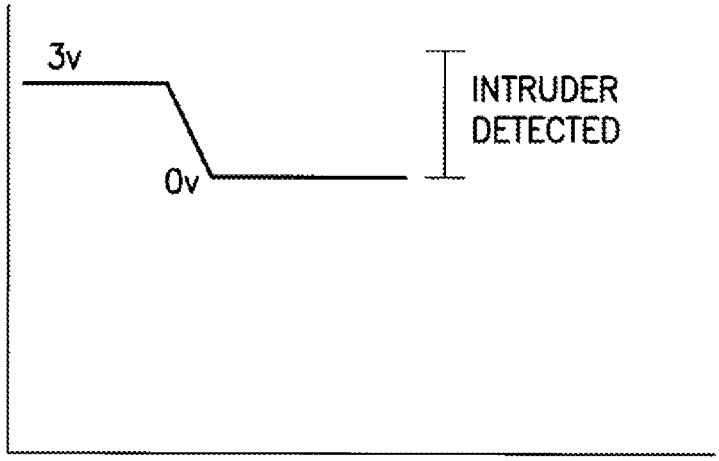
FIG. 3 shows a signal waveform of a pyro sensor according to the present invention.

When a pyro sensor 3*c* is used for detection of an intruder, the passing of a person through the sensing area can be detected. As shown in FIG. 3, a two-stage amplification circuit is used to amplify a detection signal from the sensor, and a comparator is then used to judge whether a response has sufficient intensity to indicate an intruder. If the response is sufficiently intense, a low potential is sent. A voltage high appears when no one passes by, whereas a voltage low appears when someone passes by.

Figure 4:
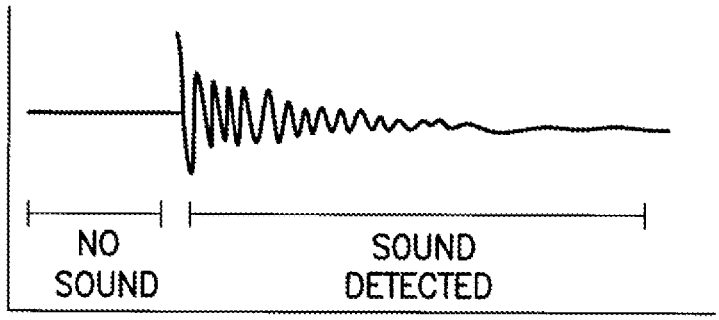
FIG. 4 shows a signal waveform of a capacitance microphone sensor according to the present invention.

The capacitance microphone sensor 3*b* detects sounds based on that the capacitance varies to produce varying signals when the environmental sound varies. As shown in FIG. 4, an audio amplifier, implemented using an LM386 chip, is used to amplify signals, and then unnecessary low-frequency signals are filtered by a high-pass filter. Waveforms are differently produced when there is sound and when there is no sound. When there is sound, the signal will vary, and hence the rising edge of the sound signal can be used to detect abnormal conditions, as shown in FIG. 4.

A 3-axis accelerometer (vibration detector) 3*a* of Freescale MMA7260QT, built in the Zigbee wireless sensor module 2 of the intruder detection system, can measure the acceleration with respect to the x-, y- and z-axes of the coordinate of the sensor, so as to detect whether there is vibration based on the signal strength. The acceleration with respect to the three axes will strongly vary at the instant when vibration occurs. For easily programming on a microcontroller, the signal magnitude vector (SMV) is defined as:

$$SMV=a^2_{x_dynamic}+a^2_{y_dynamic}+a^2_{z_dynamic} \quad (1)$$

wherein $a^2_{x_dynamic}$, $a^2_{y_dynamic}$ and $a^2_{z_dynamic}$ represent a dynamic acceleration of x-, y- and z-axes, respectively. In the present invention, the judgment is made once upon the data collected every 2 seconds. There are 256 pieces of data for each of the three axes, and the largest SMV value calculated from the 256 sets of 3-axis acceleration data is used to represent the SMV value of the 2 seconds, which is defined as SMV_max. If SMV_max is larger than a specified threshold (SMV_th), it is judged that an abnormally strong vibration has occurred in the environment.

Figure 5:
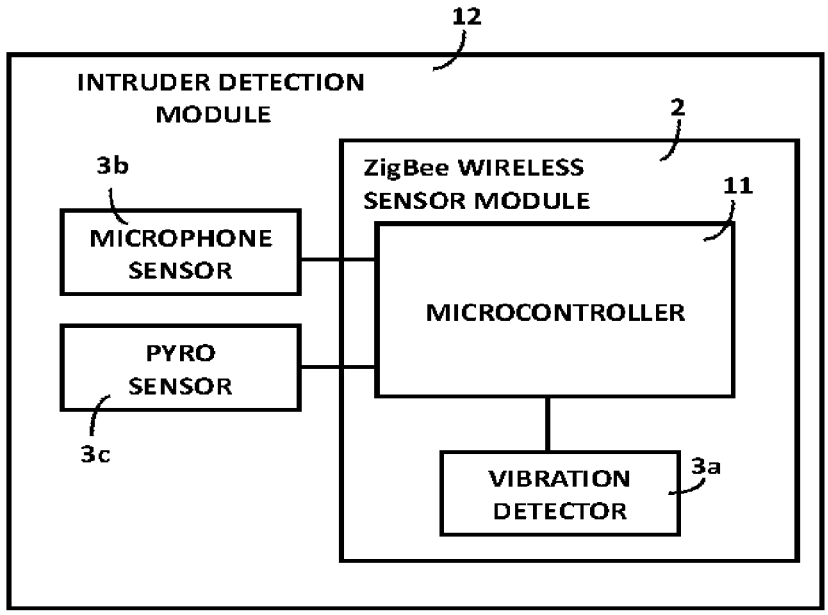
FIG. 5 is a diagram showing a circuit of an intruder detection module interface according to the present invention.

A microcontroller 11 such as Atmega128L can be used as the core of the intruder detection module 12, for communication between the sensors (3*a*, 3*b*, 3*c*, etc.) and the ZigBee chip; these three components (the microcontroller 11, the sensors 3 and the ZigBee chip) constitute the Zigbee wireless sensor module 2. As shown in FIG. 5 of the intruder detection module, the ZigBee chip is connected (e.g. using pins) to the microcontroller 11, for measuring the signals from the sensors (3*a*, 3*b*, 3*c*, etc. The program is burnt into this module with Atmel's JATC MK II burner through a JATC interface. The operational procedure of the detection system is as below:

1. After the intruder detection module 12 starts to operate, the pyro sensor 3*c* must charge up the capacitor firstly and starts to detect the environmental conditions after the completion of charging.
2. The pyro sensor 3*c* produces an external interrupt signal and sends the same to the microcontroller 11 when detecting that someone intrudes in the vicinity, and then the ZigBee CC2420 chip produces a message and sends the same out through the ZigBee wireless mesh network 4.
3. Similarly, the microphone sensor 3*b* produces an external interrupt signal and sends the same to the microcontroller 11 when detecting there is abnormal sound in the vicinity, and then the ZigBee CC2420 chip produces a message and sends the same out through the ZigBee wireless mesh network 4.
4. The microcontroller 11 calculates SMV_max once every 2 seconds, and if the microcontroller 11 judges that there occurs abnormally strong vibration in the environment, the ZigBee CC2420 chip produces a message and sends the same out through the ZigBee wireless mesh network 4.
5. The system reverts to be on standby and continues detecting the environment after completion of sending the message.

The Atmega128L microcontroller on the intruder detection module 12 can communicate with Chipon's CC2420 DBK board, and the CC2420 DBK board can connect with the control computer 7 onboard the robot 5 via a RS-232 port. Therefore, according to the present invention, a plurality of intruder detection modules 12 and a CC2420 DBK board are used to constitute a ZigBee wireless mesh network 4, in which the CC2420 DBK board is connected with the control computer 7 and the control computer 7 integrates and observes the information at each node of the ZigBee wireless mesh network 4. The intruder detection modules 12 located at the plurality of ZigBee sensing nodes in the environment can constitute a ZigBee wireless mesh network 4. In the wireless mesh network 4, the information from each sensing node can be tortuously transmitted from the nodes to a destination in a farther place. The ZigBee can be used in the present system to read the value of the sensor 3, and the sensed values at each sensor 3 are transmitted to the robot 5 through the network. Thus, the readability and expandability of data will be higher.

(Security Robot)

Figure 6:
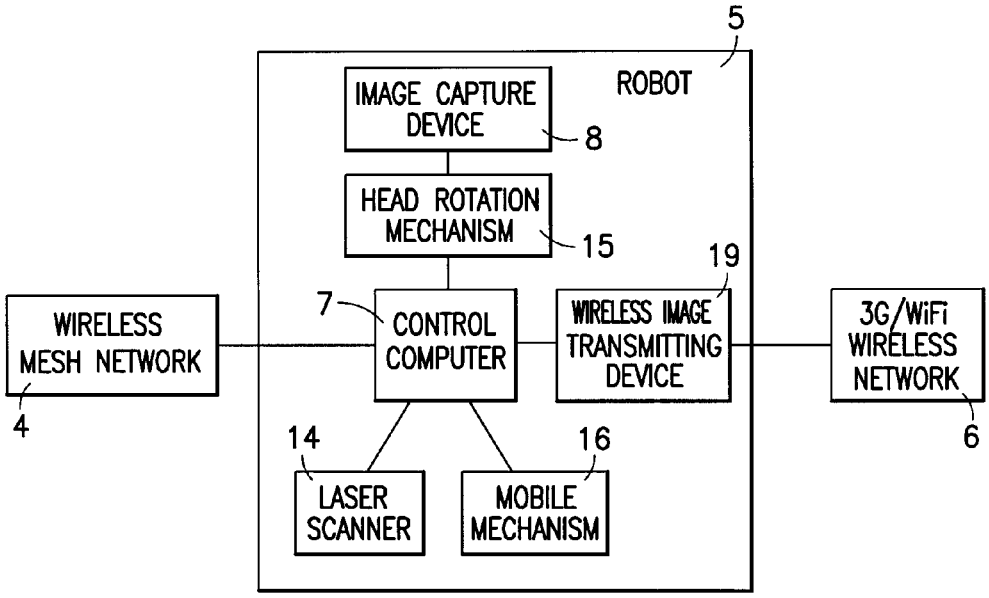
FIG. 6 shows the system architecture of a security robot according to the present invention.

The present invention is adaptable to various security robots. The system architecture of the security robot 5 in this embodiment is shown in FIG. 6. The robot 5 is a wheeled mobile platform. This platform adopts a mobile mechanism 16 having two independent driving wheels, which achieves the motion of the robot 5 on a plane by controlling the speeds of the two wheel motors. A laser scanner 14 is installed on the robot 5, for providing the robot 5 with environmental distance information so that the robot 5 can have obstacle avoidance and navigation ability. The control computer 7 of the robot 5 is an industrial computer or PC-based embedded system having 3G/WiFi communication function. A web camera is installed on the robot 5, functioning as the image capture device 8 and connecting with the control computer 7. The web camera, mounted on a head rotation mechanism 15, can rotate and capture images, which can be transmitted to the 3G/WiFi network via a wireless image transmitting device 19. The control computer 7 also connects with a Zigbee wireless sensor module 2 as a receiver for receiving signals from the ZigBee wireless mesh network 4 in the environment.

(Positioning Method of RF Signal Strength of Wireless Network)

As to the wireless network positioning, the present invention analyzes the strength of the signals sent by the Zigbee wireless sensor module 2 on the robot and received by each Zigbee wireless sensor module 2 as the network node in the environment (Received Signal Strength, RSS), which is used as a spatial characteristic of the operational environment and is used to design an indoor positioning system, which can locate the position of the robot in the deployment environment and make the robot exactly get to the place where the abnormal condition occurs. The establishment of positioning system is divided into two stages: (1) establishment of positioning database 17 and (2) position estimation.

(1) Establishment of Positioning Database 17: A sufficient amount of nodes is firstly established in the operational environment as reference points with the Zigbee wireless sensor modules 2. A signal strength sample is collected at each of these reference points, and the positioning database 17 is produced by using these collected samples.
(2) Position Estimation: The actual position of the robot in the environment is estimated by comparing the signal strength of the robot within the operational environment collected by the Zigbee wireless sensor module 2 on the robot, with the signal strength of the robot collected by Zigbee wireless sensor modules 2 in the positioning database 17.

(Establishment of Positioning Database 17)

Using RSS as a spatial characteristic requires initial establishment of a positioning database 17, which records an average value of signal strength samples collected at each reference point with respect to each Zigbee wireless sensor module 2. Each piece of data recorded in the positioning database is represented by $(x_i, y_i, ss^1_i, ss^2_i, \ldots, ss^n_i)$, wherein $x_i$ and $y_i$ represent the X-axis and Y-axis coordinates of the i-th reference point respectively, $ss^1_i, ss^2_i, \ldots, ss^n_i$ represent the average signal strength of the Zigbee wireless sensor modules 2 collected at $(x_i, y_i)$, n is the number of Zigbee wireless sensor modules 2 installed in the environment. These signal strengths can be used to identify the position of each reference point.

(Position Estimation)

The determination algorithm as used in the present invention is enhanced from the nearest neighbor algorithm (NNA) and the nearest neighbor average algorithm (NNAA). The nearest neighbor algorithm directly compares the obtained RSS value with the data in the positioning database 17 and takes the nearest corresponding position as the position of the robot. According to this algorithm, the positioning database 17 constituted by the installment of the Zigbee wireless sensor modules 2 in the environment has determined the positioning precision, and it is thus necessary to give more consideration on the installment of the Zigbee wireless sensor modules 2. The main key of the present invention is the formula for position determination, which can be expressed as below:

$$L_p = \frac{1}{N}\left(\sum_{i=1}^{N} \frac{1}{W_i}\left|Robot_{RSSI}(i) - Base_{RSSI}(i)\right|^P\right)^{\frac{1}{P}} \tag{2}$$

wherein $W_i$ represents the weight of reliability of the RSSI, $L_p$ represents the relative distance, indicative of a characteristic between the position and the distance. In the present invention, the Euclidean distance (P=2) is adopted, and the smallest $L_p$ is thus determined as the reference point closest to the place where the robot received the signal strength. The current position of the robot is determined by this method.

(Indoor Positioning System Based on Weighting between Odometer Positioning Method and Wireless Network RF Signal Strength Positioning Method)

Figure 7:
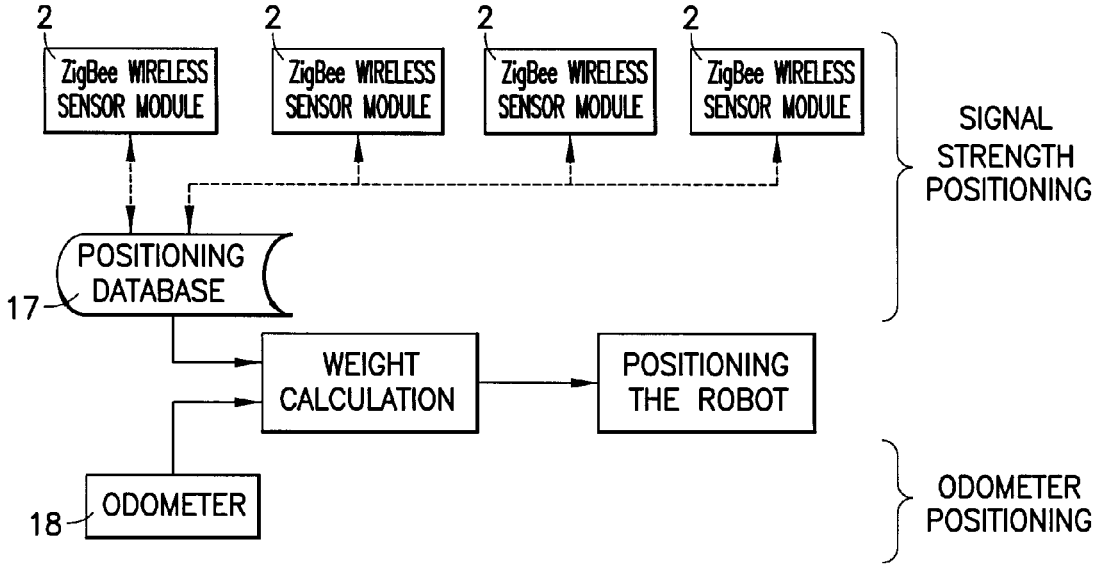
FIG. 7 is an operational flowchart of an indoor positioning system according to the present invention.

According to this embodiment, a fuzzy logic system is designed to take charge of fusing the estimated position value from RF signal strength of the Zigbee wireless sensor modules 2 and the estimated position value from an odometer 18 of wheel axle optical encoders, so as to achieve an indoor positioning system. As to the main principle of the design, it is observed that the traditional odometer positioning method accompanies an accumulated error, and as the robot travels far, the error becomes large and the reliability of positioning value becomes poor. Therefore, it is designed that the weight carried by the estimated position value of the Zigbee wireless sensor modules 2 is increased. However, when the stability of the estimated position value based on the RF signal strength of the Zigbee wireless sensor modules 2 becomes poor, indicating that the signal strength received by the Zigbee wireless sensor modules 2 is unreliable at this time, the weight carried by the estimated position value of the Zigbee wireless sensor modules 2 will be relatively adjusted lower. The operational procedure of the whole system is shown in FIG. 7, in which the fusion ratio is determined based on two quantities, i.e. the fluctuation extent of the positioning system of the Zigbee wireless sensor modules 2 and the distance that the robot travels.

(Robot Navigation System)

Figure 8:
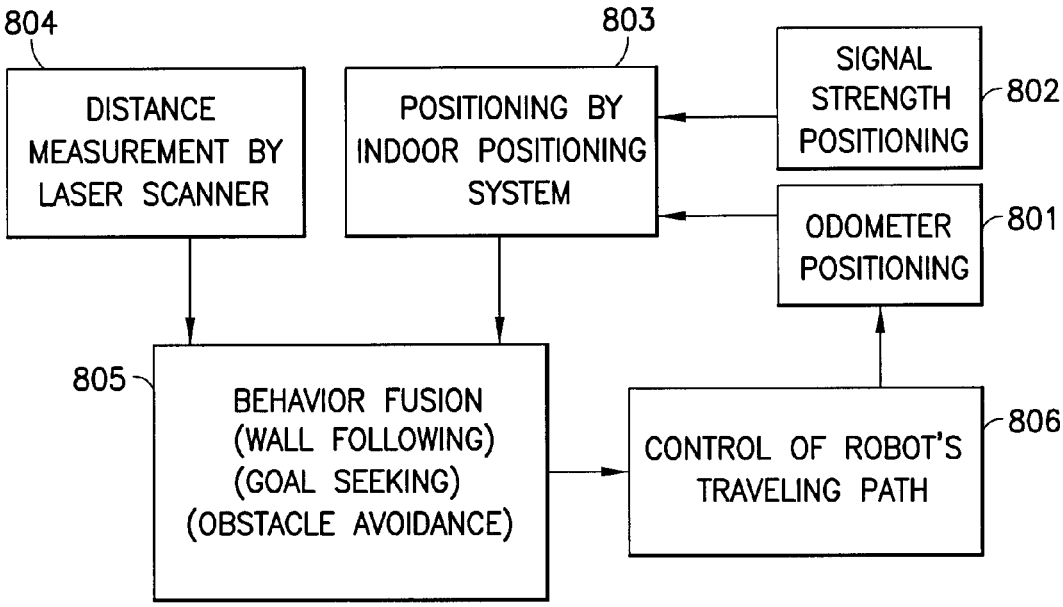
FIG. 8 is a diagram showing the architecture of a robot navigation system according to the present invention.

As to the robot, how to select proper behavior in accordance with the change of the environment is a must-solve problem in navigation designing. According to the present invention, three kinds of basic behavior are designed for the robot by using fuzzy logic in accordance with the aforementioned indoor positioning system (801, 802, 803) with the environmental information provided by the laser scanner 14 (804) on the robot 5 and the direction of the destination as inputs, including wall following, progression towards an intended destination and obstacle avoidance (805). The system architecture is shown in FIG. 8. Then, the rotational speed of the two wheels of the robot is calculated by means of a behavior fusion method so as to achieve the navigation behavior function (806). Based on the behavior fusion designing method, a fuzzy Kohonen clustering network (FKCN) is used in the present invention to treat the problem of determining the weight of each behavior. FKCN is a kind of unsupervised learning neural network and is originally used in pattern classification and recognition. Here, a designed rule table and the direction of the destination are used together to constitute a behavior fusion network, for calculating the fusion ratio between the aforementioned three kinds of behavior, which should be produced in response to the inputted environmental information.

(Image and Information Transmission)

Figure 10A:
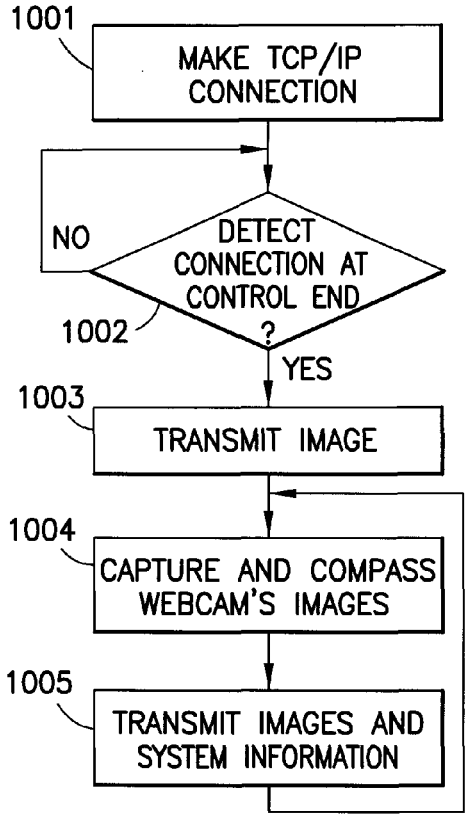
FIG. 10A represents internet transmissions.

The present invention adopts TCP/IP transmission architecture and uses Winsock as a basis for transmission. The robot can be configured as a server side and the mobile device a client side. The client side must know the IP address of the server side in order to connect with the server side. Exemplary communication transmission procedures of the server side are illustrated in FIG. 10A. After successful establishment of connection (1001, 1002), the transmission of images or commands (1003, 1005) can be conducted by using relevant program instructions, such as capturing and compressing images (1004) from the image capture device such as a webcam.

Figure 10B:
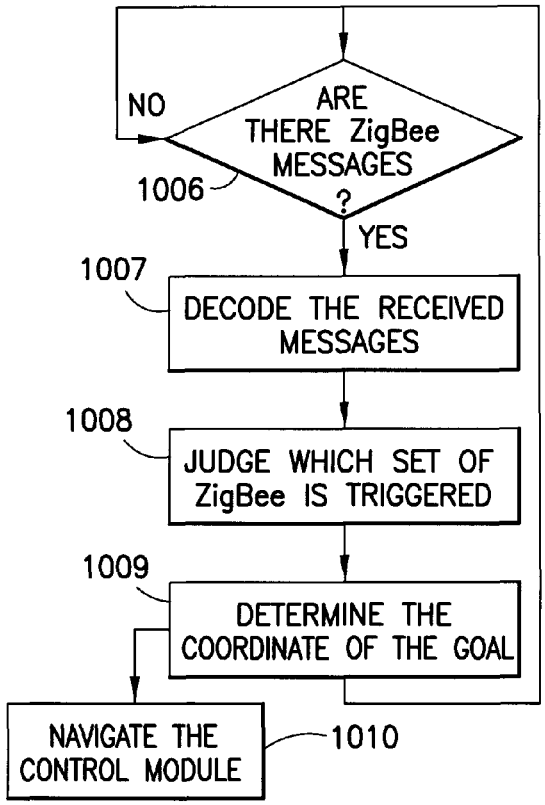
FIG. 10B represents ZigBee network transmissions and FIG. 10C represents mobile device transmissions.

Exemplary communication transmission procedures between the robot and the ZigBee wireless sensor module are illustrated in FIG. 10B. After determining whether there are any ZigBee messages (1006), the robot will decode the messages (1007), judge which set of ZigBee sensors have been triggered (1008), determine the coordinate of an intended destination (1009) based on the triggered sensors, and navigate the robot toward the intended destination (1010).

Figure 9:
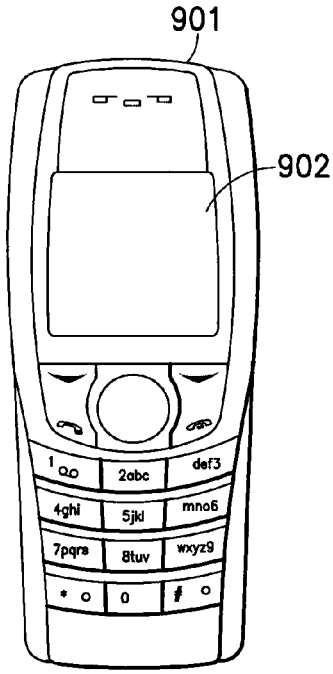
FIG. 9 illustrates display of an image captured by the security robot on a 3G cellular phone according to the present invention.
Figure 10C:
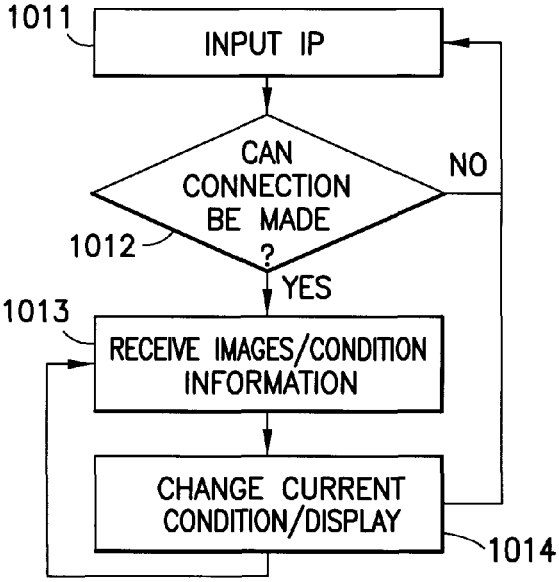

In a WiFi environment, the master control computer of the robot directly connects with the mobile device. In a 3G network, since the current 3G network IP does not provide an inter-LAN connecting mechanism, an intermediary computer is required to connect both. The intermediary computer takes charge of treating the information to be transmitted. To transmit images to a 3G cellular phone, for instance, the robot must firstly transmit the images to the intermediary computer and then the intermediary computer transmits the images to the 3G cellular phone. Therefore, the intermediary computer must function as the client side to the robot and the server side to the cellular phone, so as to connect two network areas not otherwise in direct communication. FIG. 9 shows a monitoring interface on a cellular phone 901, and it can be seen that an image captured by the robot is transmitted to and displayed on 902 the cellular phone through the 3G network. Exemplary communication transmission procedures of the mobile device in any network environment are illustrated in FIG. 10C. After the IP is inputted (1011), a test for a connection is made (1012) and, if established, the mobile device can receive images or condition information (1013) from the robot. Changes in current condition/display (1014) can also be received by the mobile device.

DESCRIPTION OF REFERENCE NUMERALS

1 intruder detection system
2 Zigbee wireless sensor module
3 sensor
3*a* vibration detector (accelerometer)
3*b* microphone sensor
3*c* pyro sensor
4 wireless mesh network
5 robot
6 3G/WiFi communication network
7 control computer
8 image capture device (camera)
9 mobile device
10 monitoring computer
11 microcontroller
12 intruder detection module
14 laser scanner
15 head rotation mechanism
16 mobile mechanism
17 positioning database
18 odometer
19 wireless image transmitting device

What is claimed is:

1. An intruder detection system having autonomous patrol and networked monitoring capability, comprising:

a plurality of sensors, deployed throughout an environment to be secured, one of said plurality of sensors sending an intrusion signal comprising at least an identification (ID) number of said one of said plurality of sensors when detecting an intrusion condition;

a wireless network for transmitting said intrusion signal sent by said one of said plurality of sensors, said wireless network comprising nodes, wherein each node comprises one or more of the plurality of sensors;

a robot capable of autonomously patrolling within the environment to be secured, during which patrol the robot is further capable of receiving said intrusion signal through said wireless network, locating said one of said plurality of sensors in accordance with the ID number of said one sensor sending said intrusion signal, approaching said location to capture an environmental image corresponding to the detected intrusion condition, and sending said environmental image via a wireless image transmitting device after compressing said environmental image; and a remote receiving device for receiving said environmental image.

2. The intruder detection system according to claim 1, wherein said wireless network is a mesh network and said intrusion signal sent by said one sensor sending said intrusion signal within any node can be transmitted to said robot via other nodes.

3. The intruder detection system according to claim 1, wherein said locating said one of said plurality of sensors comprises review by the robot of a comparison table in accordance with the ID number of said one sensor sending said intrusion signal, contained in said intrusion signal.

4. The intruder detection system according to claim 1, wherein said approaching said location comprises positioning of the robot, wherein the robot evaluates both the strength of said plurality of sensors' signals and the orientation and traveling distance of said robot within said environment to be secured.

5. The intruder detection system according to claim 1, wherein said robot has a distance measuring device, by which the distance between said robot and an obstacle is determined so that a traveling path of said robot can be adjusted based thereon.

6. The intruder detection system according to claim 1, wherein said plurality of sensors comprise: at least one of pyro sensors, capacitance microphone sensors and 3-axis accelerometers.

7. The intruder detection system according to claim 1, wherein said intrusion condition is selected from the group consisting of any one or more of abnormal sound, abnormal vibration and someone approaching.

8. The intruder detection system according to claim 1, wherein said wireless image transmitting device is any one of an RF wireless transmitting device, a 3G mobile-phone card and a WiFi wireless network device.

9. The intruder detection system according to claim 1, wherein said remote receiving device is selected from the group consisting of a notebook computer, a personal digital assistant (PDA), a smart phone and other mobile devices having a network function.

10. An intruder detection method, comprising a wireless sensor network, a remote receiving device and a robot, the method comprising the following steps:

an intruder detection step, in which one sensor of a plurality of sensors deployed throughout an environment to be secured sends an intrusion signal comprising an ID number of said one sensor when detecting an intrusion condition;

an intrusion signal transmitting step, in which said intrusion signal is transmitted through the wireless sensor network having said plurality of sensors installed therein;

an environmental image capturing step, in which said robot receives said intrusion signal through said wireless sensor network, locates said one sensor in accordance with the ID number of said one sensor, approaches said location to capture an environmental image corresponding to the detected intrusion condition, and after compressing said environmental image, sends said compressed environmental image via a wireless image transmitting device; and a remote receiving step, in which the remote receiving device receives said compressed environmental image.

11. The intruder detection method according to claim 10, wherein said wireless network is constructed as a mesh network and said intrusion signal sent by said one sensor within any node can be transmitted to said robot via other nodes of the network, wherein each node comprises one or more of the plurality of sensors.

12. The intruder detection method according to claim 10, wherein said robot locates said one sensor by looking it up in a comparison table in accordance with the ID number of said one sensor contained in said intrusion signal.

13. The intruder detection method according to claim 10, wherein approaching said location comprises positioning of the robot, wherein the robot evaluates both signal strength positioning which positions said robot according to the strength of said plurality of sensors' signals and odometer positioning which positions said robot by estimating the orientation and traveling distance of said robot within said environment to be secured.

14. The intruder detection method according to claim 10, wherein said robot determines the distance between said robot and an obstacle with a distance measuring device, thereby adjusting a traveling path of said robot.

15. The intruder detection method according to claim 10, wherein said plurality of sensors comprises: at least one of pyro sensors, capacitance microphone sensors and 3-axis accelerometers.

16. The intruder detection method according to claim 10, wherein said intrusion condition is selected from the group consisting of any one or more of abnormal sound, abnormal vibration and someone approaching.

17. The intruder detection method according to claim 10, wherein said wireless image transmitting device is any one of an RF wireless transmitting device, a 3G mobile-phone card and a WiFi wireless network device.

18. The intruder detection method according to claim 10, wherein said remote receiving device is selected from the group consisting of a notebook computer, a personal digital assistant (PDA), a smart phone and other mobile devices having a network function.

* * * * *